US009925785B2

(12) United States Patent
Yoshida et al.

(10) Patent No.: US 9,925,785 B2
(45) Date of Patent: Mar. 27, 2018

(54) LIQUID DISCHARGE HEAD, LIQUID DISCHARGE DEVICE, AND LIQUID DISCHARGE APPARATUS

(71) Applicants: Takahiro Yoshida, Ibaraki (JP); Tomohiko Kohda, Ibaraki (JP); Takayuki Nakai, Kanagawa (JP)

(72) Inventors: Takahiro Yoshida, Ibaraki (JP); Tomohiko Kohda, Ibaraki (JP); Takayuki Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/256,785

(22) Filed: Sep. 6, 2016

(65) Prior Publication Data

US 2017/0087865 A1 Mar. 30, 2017

(30) Foreign Application Priority Data

Sep. 30, 2015 (JP) ..... 2015-194068
Jun. 30, 2016 (JP) ..... 2016-129652

(51) Int. Cl.
*B41J 2/175* (2006.01)
*B41J 2/18* (2006.01)

(52) U.S. Cl.
CPC ..... *B41J 2/17563* (2013.01); *B41J 2/175* (2013.01); *B41J 2/18* (2013.01)

(58) Field of Classification Search
CPC ..... B41J 2/17563; B41J 2/175; B41J 2/18
See application file for complete search history.

(56) References Cited

U.S. PATENT DOCUMENTS 6,048,057 A * 4/2000 Kanemoto ..... B41J 2/17593 347/88
8,011,765 B2 * 9/2011 Katoh ..... B41J 2/14145 347/85

(Continued)

FOREIGN PATENT DOCUMENTS

JP 2012-143948 8/2012
JP 2015-071289 4/2015

OTHER PUBLICATIONS

U.S. Appl. No. 15/092,755, filed Apr. 7, 2016.

*Primary Examiner* — Justin Seo
(74) *Attorney, Agent, or Firm* — Cooper & Dunham LLP

(57) ABSTRACT

A liquid discharge head includes a plurality of nozzles, a plurality of individual liquid chambers, a common liquid chamber, a common circulation liquid chamber, and a filter portion. The common liquid chamber includes a first portion disposed side by side with the common circulation liquid chamber in a direction perpendicular to a nozzle array direction in and a second portion not disposed side by side with the common circulation liquid chamber in the direction perpendicular to the nozzle array direction. In a plan view, the second portion partially overlaps the common circulation liquid chamber in the direction perpendicular to the nozzle array direction. A width of the second portion in the direction perpendicular to the nozzle array direction is greater than a width of the first portion in the direction perpendicular to the nozzle array direction. In the plan view, the filter portion is disposed in the second portion.

10 Claims, 9 Drawing Sheets

(56) References Cited

U.S. PATENT DOCUMENTS

| | | | | |
|---|---|---|---|---|
| 2003/0210305 | A1* | 11/2003 | Ito | B41J 2/14209 347/68 |
| 2012/0162331 | A1* | 6/2012 | Kataoka | B41J 2/175 347/89 |
| 2012/0176450 | A1* | 7/2012 | Akahane | B41J 2/14233 347/47 |
| 2014/0218450 | A1* | 8/2014 | Yoneta | B41J 2/17563 347/93 |
| 2015/0062255 | A1 | 3/2015 | Sasaki | |
| 2015/0306875 | A1 | 10/2015 | Nishimura et al. | |
| 2016/0185113 | A1 | 6/2016 | Yoshida et al. | |
| 2016/0297193 | A1* | 10/2016 | Yoshida | B41J 2/14274 |
| 2017/0173946 | A1* | 6/2017 | Yamanaka | B41J 2/14274 |
| 2017/0217181 | A1* | 8/2017 | Yamada | B41J 2/14233 |
| 2017/0247561 | A1* | 8/2017 | Nakagawa | C09D 11/54 |
| 2017/0297333 | A1* | 10/2017 | Kohda | B41J 2/14056 |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2015-194068 filed on Sep. 30, 2015 and 2016-129652 filed on Jun. 30, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid, for example, a circulation-type head is known that circulates liquid in a plurality of individual liquid chambers.

SUMMARY

In an aspect of the present disclosure, there is provided a liquid discharge head that includes a plurality of nozzles, a plurality of individual liquid chambers, a common liquid chamber, a common circulation liquid chamber, and a filter portion. The plurality of nozzles discharges liquid. The plurality of individual liquid chambers is communicated with the plurality of nozzles. The common liquid chamber supplies liquid to the plurality of individual liquid chambers. The common circulation liquid chamber is communicated with the plurality of individual liquid chambers. The filter portion is disposed in the common liquid chamber to filter liquid. The common liquid chamber includes a first portion and a second portion. The first portion is disposed side by side with the common circulation liquid chamber in a direction perpendicular to a nozzle array direction in which the plurality of nozzles is arrayed in row. The second portion is not disposed side by side with the common circulation liquid chamber in the direction perpendicular to the nozzle array direction. In a plan view, the second portion partially overlaps the common circulation liquid chamber in the direction perpendicular to the nozzle array direction. A width of the second portion in the direction perpendicular to the nozzle array direction is greater than a width of the first portion in the direction perpendicular to the nozzle array direction. In the plan view, the filter portion is disposed in the second portion.

In another aspect of the present disclosure, there is provided a liquid discharge device that includes the liquid discharge head to discharge liquid.

In still another aspect of the present disclosure, there is provided a liquid discharge apparatus that includes the liquid discharge device to discharge liquid.

In still yet another aspect of the present disclosure, there is provided a liquid discharge apparatus that includes the liquid discharge head to discharge liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
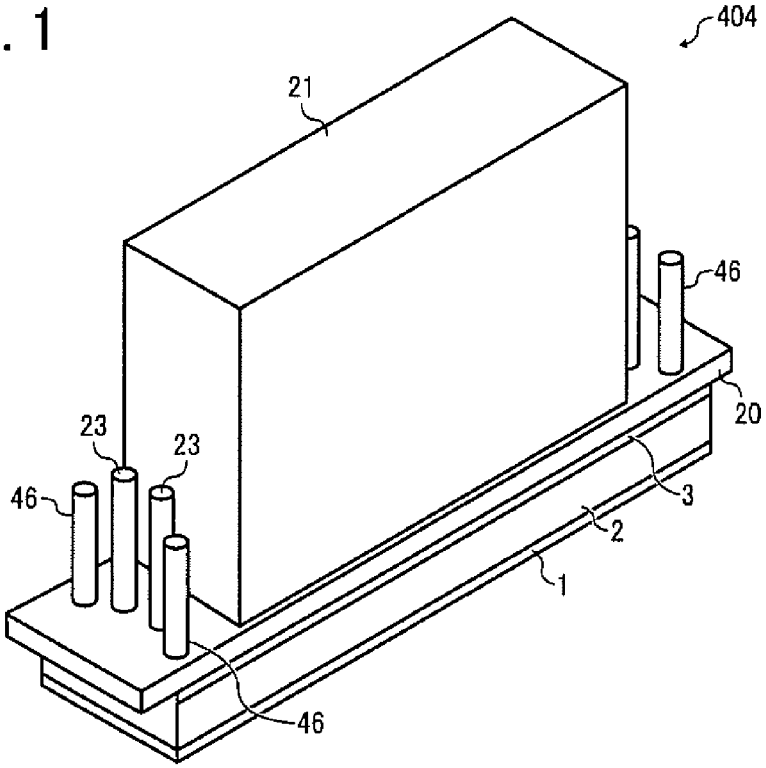
FIG. 1 is an outer perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
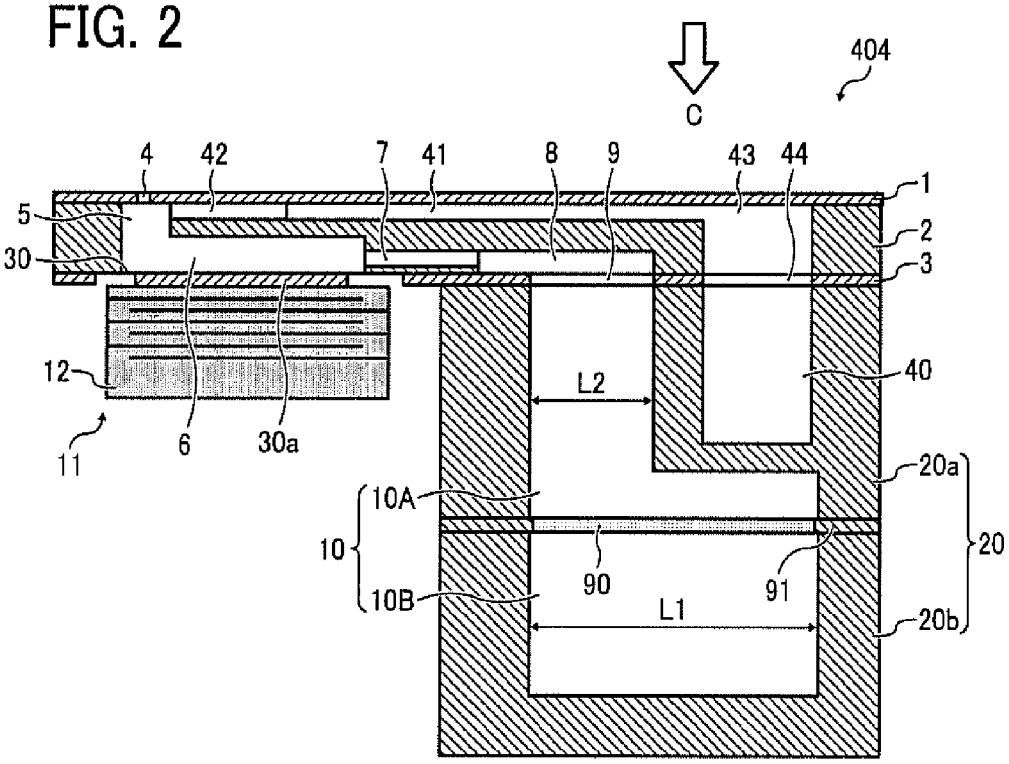
FIG. 2 is a cross-sectional view of the liquid discharge head of FIG. 1, cut in a direction (a longitudinal direction of an individual liquid chamber) perpendicular to a nozzle array direction in which nozzles are arrayed in row.
Figure 3:
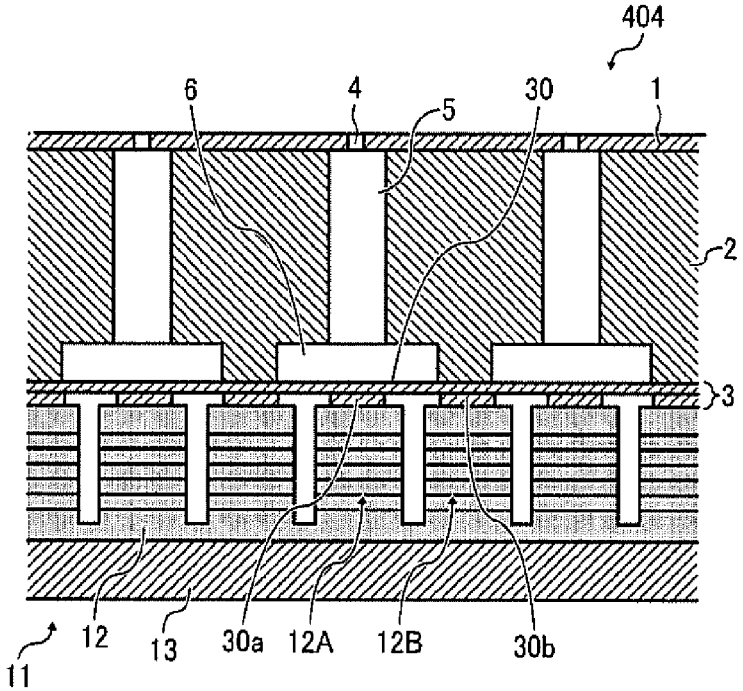
FIG. 3 is a cross-sectional view of the liquid discharge head of FIG. 1 cut in the nozzle array direction.

Hereinafter, embodiments of the present disclosure are described with reference to the attached drawings. A liquid discharge head according to a first embodiment of the present disclosure is described with reference to FIGS. 1 to 3. FIG. 1 is an outer perspective view of the liquid discharge head according to the first embodiment. FIG. 2 is a cross-sectional view of the liquid discharge head of FIG. 1 cut in a direction (a longitudinal direction of an individual liquid chamber) perpendicular to a nozzle array direction in which nozzles are arrayed in row. FIG. 3 is a cross-sectional view of the liquid discharge head of FIG. 1 cut in the nozzle array direction. Note that liquid is discharged downward in FIG. 1 and upward in FIGS. 2 and 3.

A liquid discharge head 404 according to the first embodiment of the present disclosure includes a nozzle plate 1, a channel plate 2, and a diaphragm member 3 as a wall member that are laminated one on another and bonded to each other. The liquid discharge head 404 includes piezoelectric actuators 11 to displace the diaphragm member 3, a frame member 20 as a common-liquid-chamber substrate, and a cover 21.

The nozzle plate 1 includes a plurality of nozzles 4 to discharge liquid.

The channel plate 2 includes passages 5 communicated with the nozzles 4, individual liquid chambers 6 communicated with the passages 5, fluid restrictors 7 communicated with the individual liquid chambers 6, through-holes and grooves forming liquid inlets (liquid passages) 8 communicated with the fluid restrictors 7.

The diaphragm member 3 includes openings 9 communicating the liquid inlets 8 with a common liquid chamber 10.

The diaphragm member 3 is a wall member forming walls of the individual liquid chambers 6 of the channel plate 2. The diaphragm member 3 has a two-layer structure including a first layer including thin portions and facing the channel plate 2 and a second layer including thick portions. The first layer includes deformable vibration portions (diaphragms) 30 at positions corresponding to the individual liquid chambers 6. The diaphragm member 3 and the channel plate 2 constitute a channel member.

The piezoelectric actuators 11 including electromechanical transducer elements as driving devices (actuator devices or pressure generators) to deform the vibration portions 30 of the diaphragm member 3 are disposed at a first side of the diaphragm member 3 opposite a second side facing the individual liquid chambers 6.

The piezoelectric actuator 11 includes piezoelectric members 12 bonded on a base 13. The piezoelectric members 12 are groove-processed by half cut dicing so that each piezoelectric member 12 includes a desired number of pillar-shaped piezoelectric elements (piezoelectric pillars) 12A and pillar-shaped piezoelectric elements (piezoelectric pillars) 12B that are arranged in certain intervals to have a comb shape.

In the first embodiment, the piezoelectric elements 12A of the piezoelectric member 12 are piezoelectric elements to be driven by application of drive waveforms and the piezoelectric elements 12B are supports to which no drive waveform is applied. In some embodiments, all of the piezoelectric elements 12A and the piezoelectric elements 12B may be piezoelectric elements to be driven by application of drive waveforms.

The piezoelectric elements 12A are bonded to projections 30*a* being island-shaped thick portions in the vibration portions 30 of the diaphragm member 3. The piezoelectric elements 12B are bonded to projections 30*b* being thick portions of the diaphragm member 3.

The piezoelectric member 12 includes piezoelectric layers and internal electrodes that are alternately laminated. The internal electrodes are led out to end faces of the piezoelectric elements 12A and the piezoelectric elements 12B to form external electrodes.

The frame member 20 is bonded to the diaphragm member 3 to form the common liquid chambers 10 and common circulation liquid chambers 40. The common liquid chamber 10 supplies liquid to the individual liquid chambers 6. Liquid returned from the individual liquid chambers 6 flow into the common circulation liquid chamber 40. In the present embodiment, the common circulation liquid chamber 40 is disposed facing the diaphragm member 3.

The channel plate 2 includes circulation channels 41, circulation restrictors 42, and passages 43. The circulation channels 41 are communicated with the respective individual liquid chambers 6 and disposed at a nozzle plate side of the channel plate 2 opposite an individual-liquid-chamber side facing the individual liquid chamber 6. The circulation restrictors 42 are formed by grooves to communicate the circulation channels 41 with the passages 5. The passages 43 are formed by through-holes to communicate the circulation channels 41 with the common circulation liquid chambers 40. The diaphragm member 3 includes openings 44 communicating the passages 43 with the common circulation liquid chambers 40.

The frame member 20 includes supply ports 23 communicated with the common liquid chambers 10 and circulation ports (delivery ports) 46 communicated with the common circulation liquid chambers 40.

In the liquid discharge head 404 thus configured, for example, when a voltage lower than a reference potential is applied to the piezoelectric element 12A, the piezoelectric element 12A contracts. Accordingly, the vibration portion 30 of the diaphragm member 3 moves downward in FIG. 3 and the volume of the individual liquid chamber 6 increases, thus causing liquid to flow into the individual liquid chamber 6.

When the voltage applied to the piezoelectric element 12A is raised, the piezoelectric element 12A extends in a direction of lamination. Accordingly, the vibration portion 30 of the diaphragm member 3 deforms in a direction toward the nozzle 4 and the volume of the individual liquid chamber 6 reduces. Thus, liquid in the individual liquid chamber 6 is pressurized and discharged from the nozzle 4.

When the voltage applied to the piezoelectric element 12A is returned to the reference potential, the vibration portion 30 of the diaphragm member 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head 404 is not limited to the above-described example (pull-push discharge). For example, pull discharge or push discharge may be performed in accordance with the way to apply a drive waveform.

Figure 4:
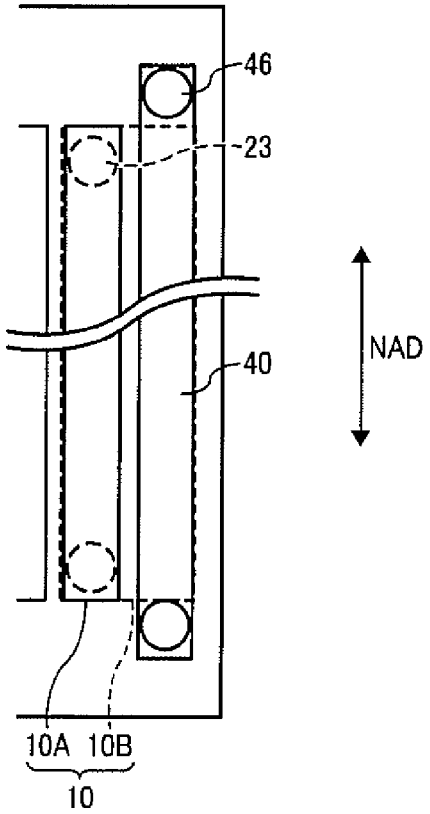
FIG. 4 is a plan view of a portion of a frame member of the liquid discharge head according to the first embodiment, seen from a direction indicated by arrow C in FIG. 2.

Next, the arrangement of the common liquid chamber, the common circulation liquid chamber, and a filter portion according to the first embodiment is described with reference to FIG. 4. FIG. 4 is a plan view of a portion of the frame member of the liquid discharge head according to the first embodiment, seen from a direction indicated by arrow C in FIG. 2.

As described above, the frame member 20 as a common-liquid-chamber substrate is bonded to the diaphragm member 3 to form the common liquid chambers 10 and the common circulation liquid chambers 40. The common liquid chamber 10 supplies liquid to the individual liquid chambers 6. Liquid returned from the individual liquid chambers 6 flow into the common circulation liquid chamber 40. In FIG. 4, the common circulation liquid chamber 40 is disposed at a side of the frame member 20 at which the frame member 20 is bonded to a channel member (the diaphragm member 3 in the first embodiment).

The common circulation liquid chamber 40 is disposed side by side with a portion of the common liquid chamber 10 in a direction perpendicular to the nozzle array direction indicated by arrow NAD in FIG. 4. The common liquid chamber 10 includes a first portion 10A disposed side by side with the common circulation liquid chamber 40 and a second portion 10B not disposed side by side with the common circulation liquid chamber 40.

In the first embodiment, when a side of the common liquid chamber 10 communicated with the individual liquid chambers 6 is referred to as a downstream side in a direction of flow of liquid in the liquid discharge head 404, the first portion 10A disposed side by side with the common circulation liquid chamber 40 is a downstream portion and the second portion 10B not disposed side by side with the common circulation liquid chamber 40 is an upstream portion.

For the present embodiment, in a plan view (a state seen from the direction indicated by arrow C in FIG. 2 or a state illustrated in FIG. 4), the second portion 10B of the common liquid chamber 10, which is not disposed side by side with the common circulation liquid chamber 40, partially overlaps the common circulation liquid chamber 40 in the direction perpendicular to the nozzle array direction NAD. In other words, in the direction perpendicular to the nozzle array direction NAD, the common circulation liquid chamber 40 is projected onto the second portion 10B of the common liquid chamber 10, which is not disposed side by side with the common circulation liquid chamber 40.

In the present embodiment, in the plan view, the first portion 10A of the common liquid chamber 10 and the common circulation liquid chamber 40 are included in the second portion 10B in the direction perpendicular to the nozzle array direction NAD.

As illustrated in FIG. 2, the second portion 10B of the common liquid chamber 10 has a greater width L1 in the direction perpendicular to the nozzle array direction NAD than a width L2 of the first portion 10A in the direction perpendicular to the nozzle array direction NAD.

A filter portion 90 to filter liquid flowing the common liquid chamber 10 is disposed in the second portion 10B of the common liquid chamber 10, which is not disposed side by side with the common circulation liquid chamber 40.

In the present embodiment, the frame member 20 is divided into a first member 20*a* and a second member 20*b*, and a filter member 91 including the filter portion 90 is interposed between the first member 20*a* and the second member 20*b*.

The filter member 91 including the filter portion 90 is a nickel (Ni) electroforming component. Such a configuration facilitates the formation of fine filter holes and the assurance of liquid resistance and reliability in bonding to the frame member 20.

Note that the diaphragm member 3 is also an Ni electroforming component, thus facilitating the assurance of reliability in bonding to the frame member 20 and good liquid contact.

As described above, the common circulation liquid chamber 40 and the first portion 10A of the common liquid chamber 10 are disposed side by side in the nozzle array direction. Such a configuration allows the width of the liquid discharge head to be smaller than a configuration in which the common circulation liquid chamber 40 and the entire of the common liquid chamber 10 are disposed side by side.

In addition, the width L1 of the second portion 10B not disposed side by side with the common circulation liquid chamber 40 is greater than the width L2 of the first portion 10A disposed side by side with the common circulation liquid chamber 40, and the filter portion 90 is disposed in the second portion 10B. Such a configuration can obtain a filter area equivalent to a filter area in the configuration in which the entire of the common liquid chamber 10 and the common circulation liquid chamber 40 are disposed side by side.

Such a configuration can obtain a relatively large filter area while preventing an increase in the size of the liquid discharge head.

Figure 5:
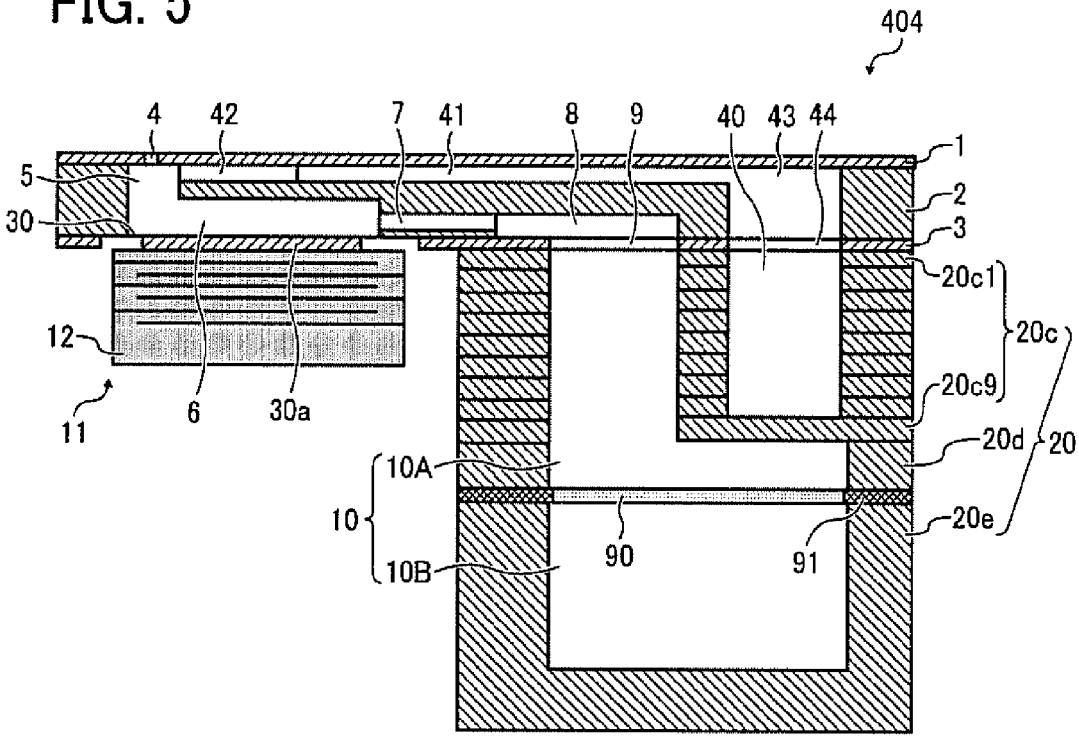
FIG. 5 is a cross-sectional view of the liquid discharge head according to a second embodiment of the present disclosure, cut in the direction perpendicular to the nozzle array direction.

Next, the liquid discharge head according to a second embodiment of the present disclosure is described with reference to FIG. 5. FIG. 5 is a cross-sectional view of the liquid discharge head according to the second embodiment, cut in the direction perpendicular to the nozzle array direction.

The frame member 20 being a common-liquid-chamber substrate includes a first member 20*c*, a second member 20*d*, and a third member 20*e*. The first member 20*c* is disposed at a most downstream position, and the filter member 91 is interposed between the second member 20*d* and the third member 20*e*.

Here, the first member 20*c* being at least part of the common-liquid-chamber substrate includes a plurality of plates that is laminated one on another and bonded to each other. In the present embodiment, nine plates 20*c*1 through 20*c*9 are illustrated in FIG. 5. Note that the number of plates is not limited to nine and two or more plates, other than nine, may be used.

Such lamination of the plurality of plates allows the frame member 20 (common-liquid-chamber substrate) having a high degree of flatness to be obtained at low cost.

Division of the first member 20*c* and the second member 20*d* allows pressing all surfaces in laminating and bonding the plurality of plates 20*c*1 through 20*c*9 of the first member 20*c*.

Similarly with the first member 20*c*, the third member 20*e* may include a plurality of (two or more) plates that is laminated one on another and bonded to each other.

Figure 6:
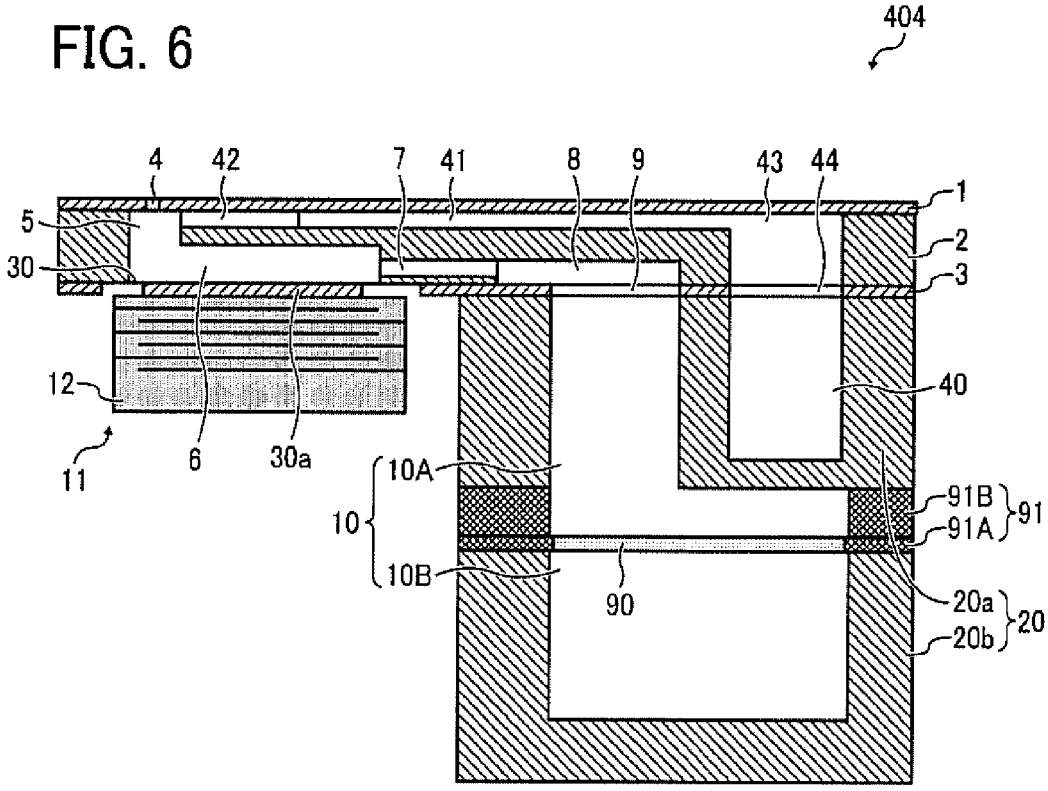
FIG. 6 is a cross-sectional view of the liquid discharge head according to a third embodiment of the present disclosure, cut in the direction perpendicular to the nozzle array direction.

Next, the liquid discharge head according to a third embodiment of the present disclosure is described with reference to FIG. 6. FIG. 6 is a cross-sectional view of the liquid discharge head according to the third embodiment, cut in the direction perpendicular to the nozzle array direction.

The filter member 91 includes a thin portion 91A forming the filter portion 90 and a thick portion 91B around the thin portion 91*a*. In the present embodiment, a layer of the thick portion 91B is laminated on a layer of the thin portion 91A.

In some embodiments, the thin portion 91A and the thick portion 91B are formed with a single member.

The filter member 91 is disposed so that a part of the thick portion 91B thicker than the thin portion 91A is disposed at a downstream side.

Such a configuration facilitates handling of the filter member 91.

Such a configuration can also obtain a simpler shape of the frame member 20 than the shape of the frame member 20 in the above-described first embodiment.

Figure 7:
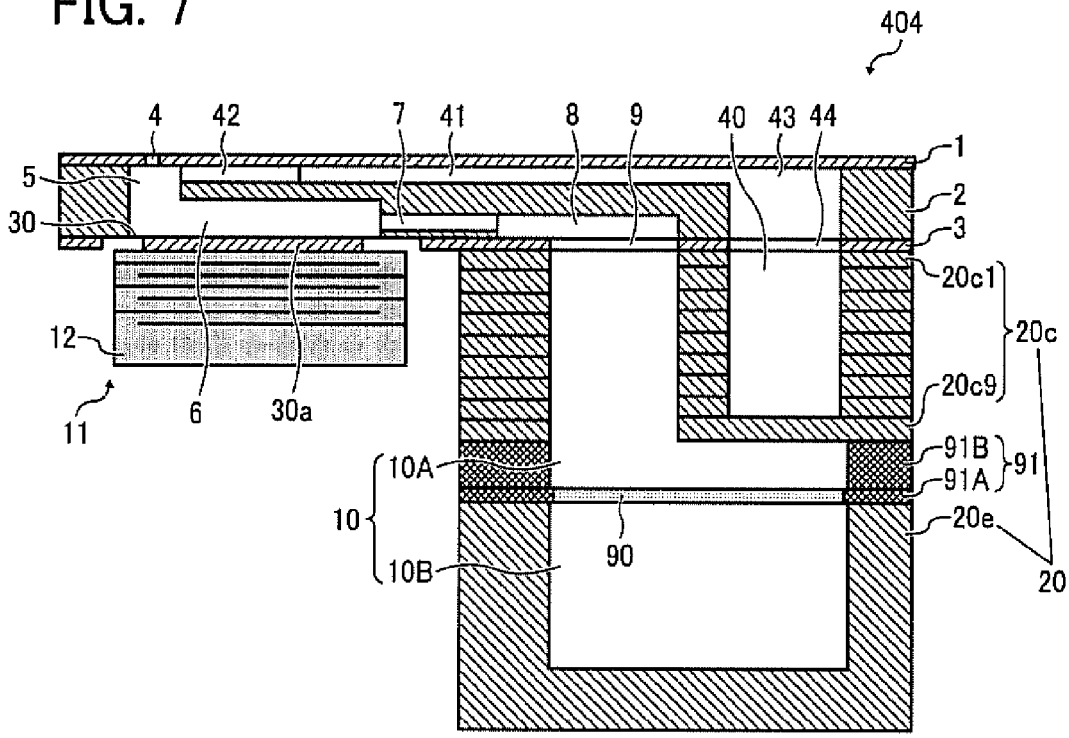
FIG. 7 is a cross-sectional view of the liquid discharge head according to a fourth embodiment of the present disclosure, cut in the direction perpendicular to the nozzle array direction.

Next, the liquid discharge head according to a fourth embodiment of the present disclosure is described with reference to FIG. 7. FIG. 7 is a cross-sectional view of the liquid discharge head according to the fourth embodiment, cut in the direction perpendicular to the nozzle array direction.

For the third embodiment, a portion corresponding to the second member 20*d* in the second embodiment is formed with the thick portion 91B of the filter member 91.

Such a configuration can reduce the number of components than the number of components in the second embodiment.

Figure 8:
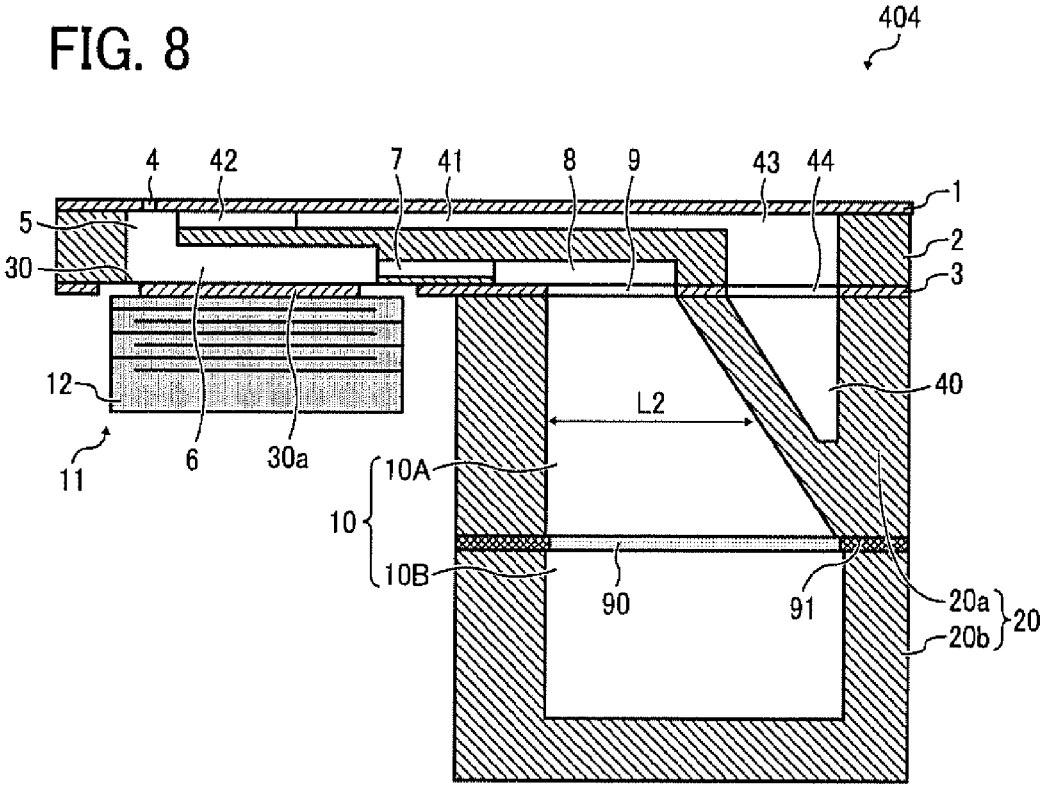
FIG. 8 is a cross-sectional view of the liquid discharge head according to a fifth embodiment of the present disclosure, cut in the direction perpendicular to the nozzle array direction.

Next, the liquid discharge head according to a fifth embodiment of the present disclosure is described with reference to FIG. 8. FIG. 8 is a cross-sectional view of the liquid discharge head according to the fifth embodiment, cut in the direction perpendicular to the nozzle array direction.

For the present embodiment, the width L2 of the first portion 10A of the common liquid chamber 10, which is disposed side by side with the common circulation liquid chamber 40, is smaller toward the downstream side.

Such a configuration can increase the speed of flow of liquid from the filter portion 90 toward the individual liquid chamber 6, thus enhancing the efficiency of delivering bubbles.

Figure 9:
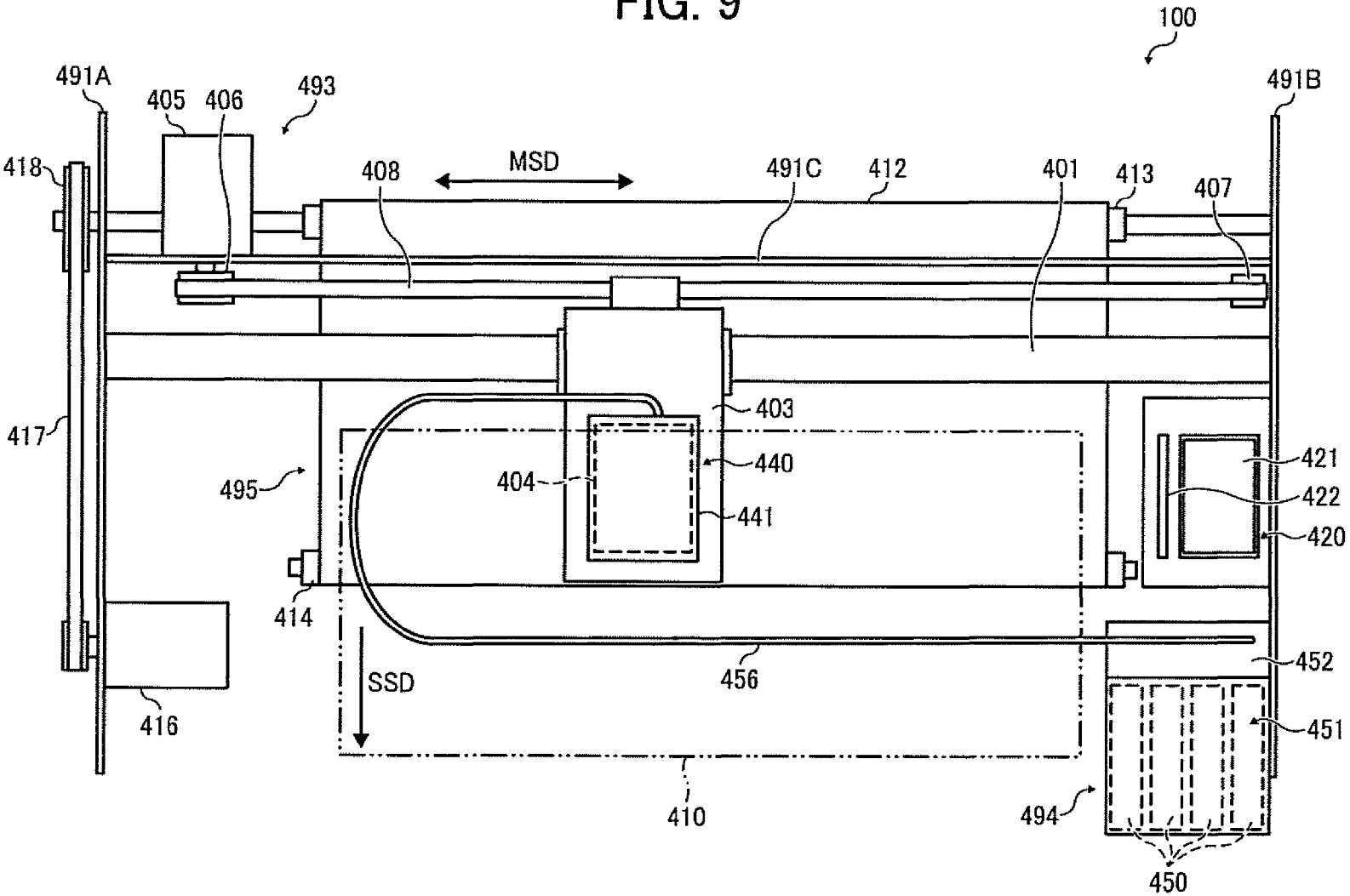
FIG. 9 is a plan view of a portion of a liquid discharge apparatus according to an embodiment of the present disclosure.
Figure 10:
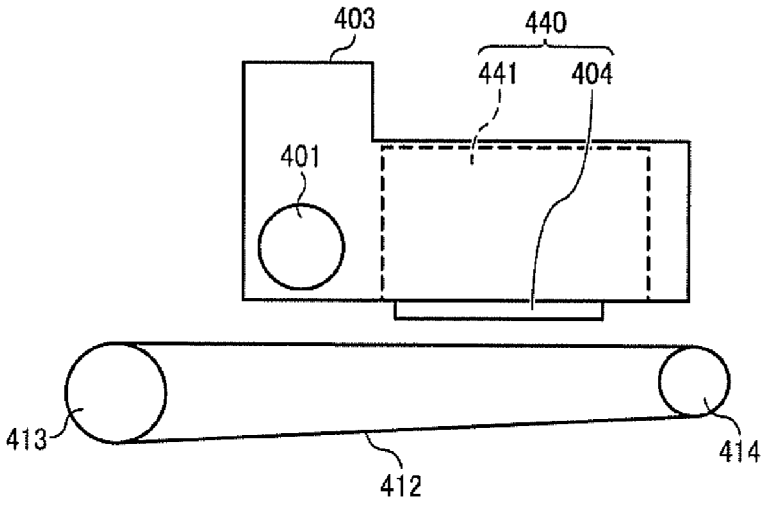
FIG. 10 is a side view of a portion of the liquid discharge apparatus of FIG. 10 including a liquid discharge device according to an embodiment of the present disclosure.

Next, a liquid discharge apparatus according to an embodiment of the present disclosure is described with reference to FIGS. 9 and 10. FIG. 9 is a plan view of a portion of the liquid discharge apparatus according to an embodiment of the present disclosure. FIG. 10 is a side view of a portion of the liquid discharge apparatus of FIG. 9.

A liquid discharge apparatus 100 according to the present embodiment is a serial-type apparatus in which a main scan moving unit 493 reciprocally moves a carriage 403 in a main scanning direction indicated by arrow MSD in FIG. 9. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 9, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridges 450 are detachably mounted to the cartridge holder 451. The liquid is supplied to the head tank 441 by the liquid feed unit 452 via the tube 456 from the liquid cartridges 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 11:
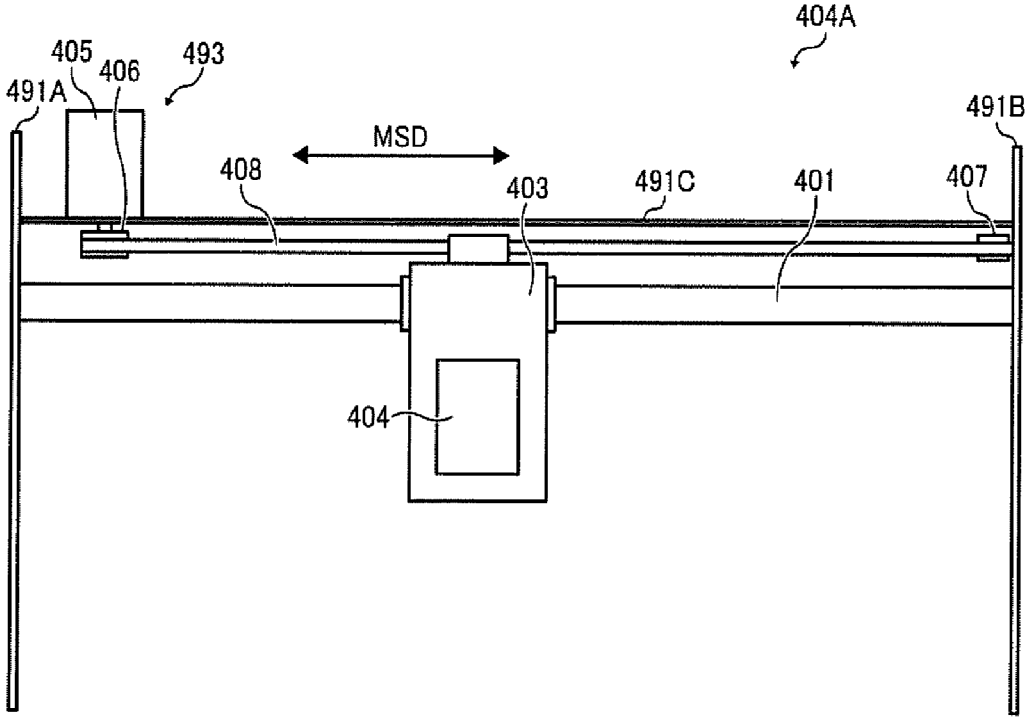
FIG. 11 is a plan view of a portion of the liquid discharge device according to another embodiment of the present disclosure.

Next, another example of the liquid discharge device according to an embodiment of the present disclosure is described with reference to FIG. 11. FIG. 11 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 12:
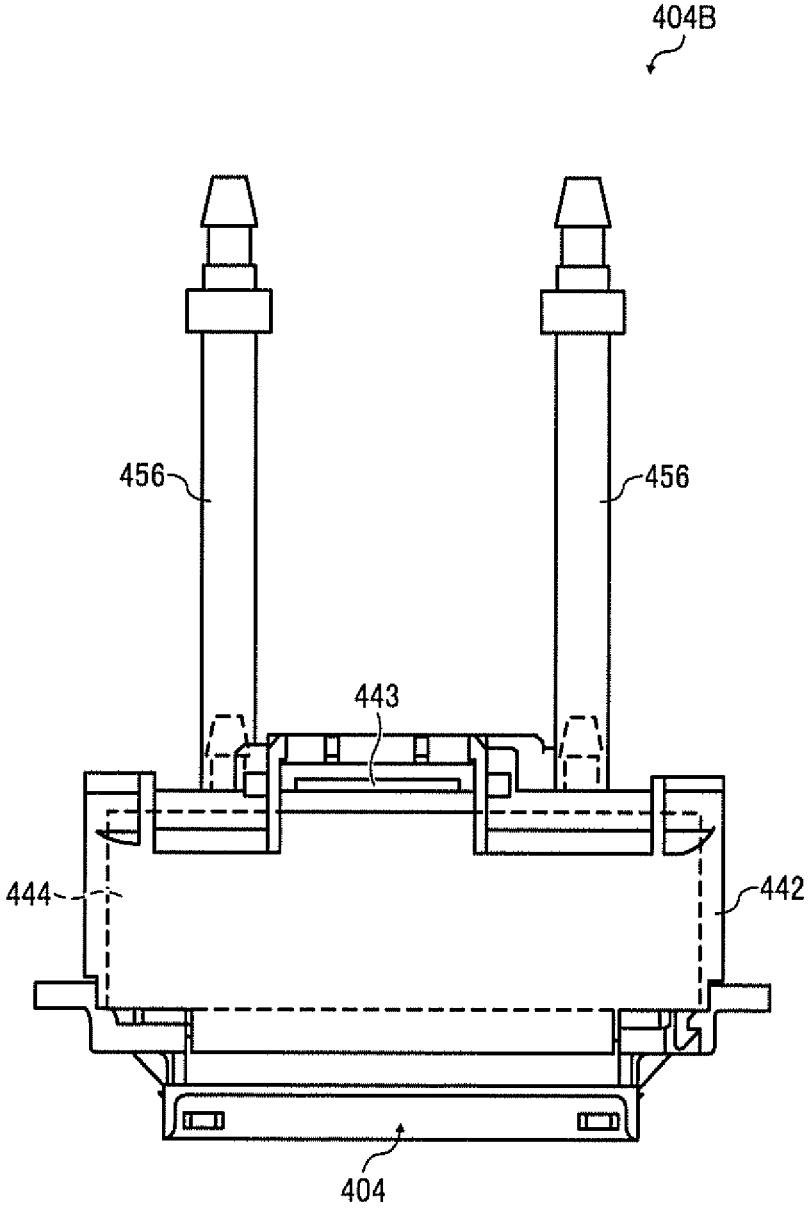
FIG. 12 is a front view of the liquid discharge device according to still another embodiment of the present disclosure.

Next, still another example of the liquid discharge device according to an embodiment of the present disclosure is described with reference to FIG. 12. FIG. 12 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 13:
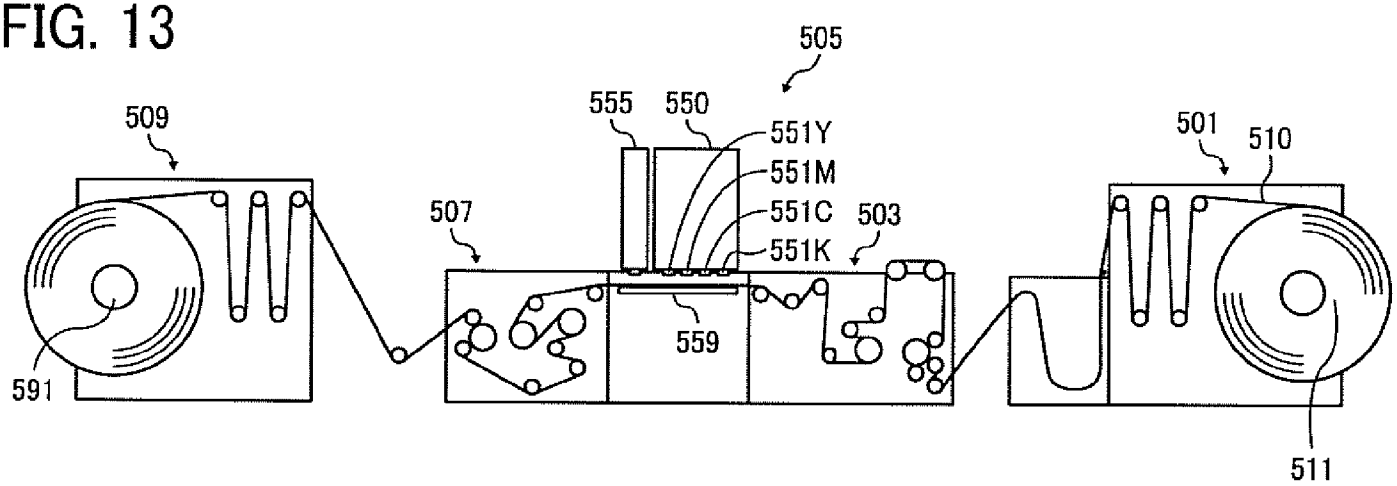
FIG. 13 is an illustration of the liquid discharge apparatus according to another embodiment of the present disclosure.
Figure 14:
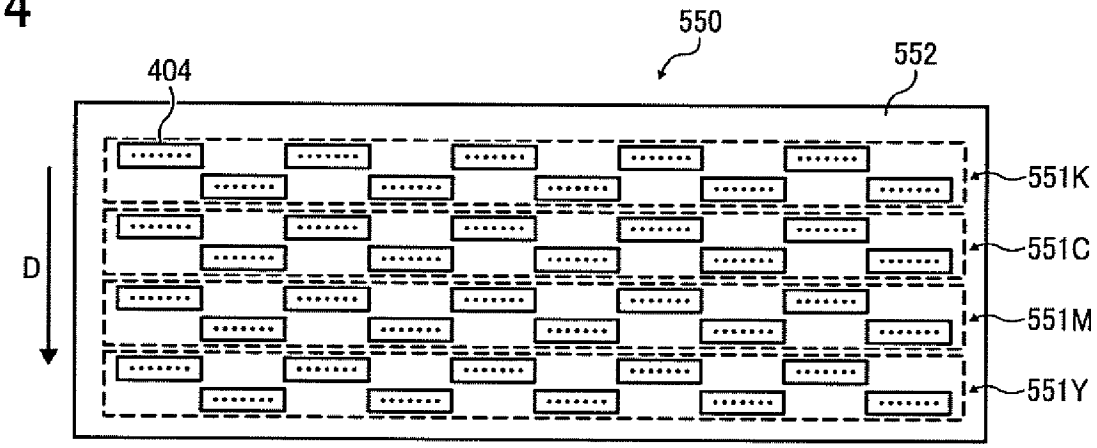
FIG. 14 is a plan view of a head unit of the liquid discharge apparatus of FIG. 13 according to an embodiment of the present disclosure.

Next, another example of the liquid discharge apparatus according to an embodiment of the present disclosure is described with reference to FIGS. 13 and 14. FIG. 13 is an illustration of the liquid discharge apparatus according to an embodiment of the present disclosure. FIG. 14 is a plan view of a head unit of the liquid discharge apparatus.

The liquid discharge apparatus 100 includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the continuous medium 510 (hereinafter, "medium feed direction") indicated by arrow D in FIG. 14.

The head arrays 551K, 551C, 551M, and 551Y are liquid dischargers to discharge liquid of black (K), cyan (C), magenta (M), and yellow (Y) onto the continuous medium 510. Noted that the number and types of color are not limited to the above-described four colors of K, C, M, and Y and may be any other suitable number and types.

In each head array 551, for example, as illustrated in FIG. 14, a plurality of liquid discharge heads (also referred to as simply "heads") 404 are arranged in a staggered manner on a base 552 to form the head array. Noted that the configuration of the head array 551 is not limited to such a configuration.

Figure 15:
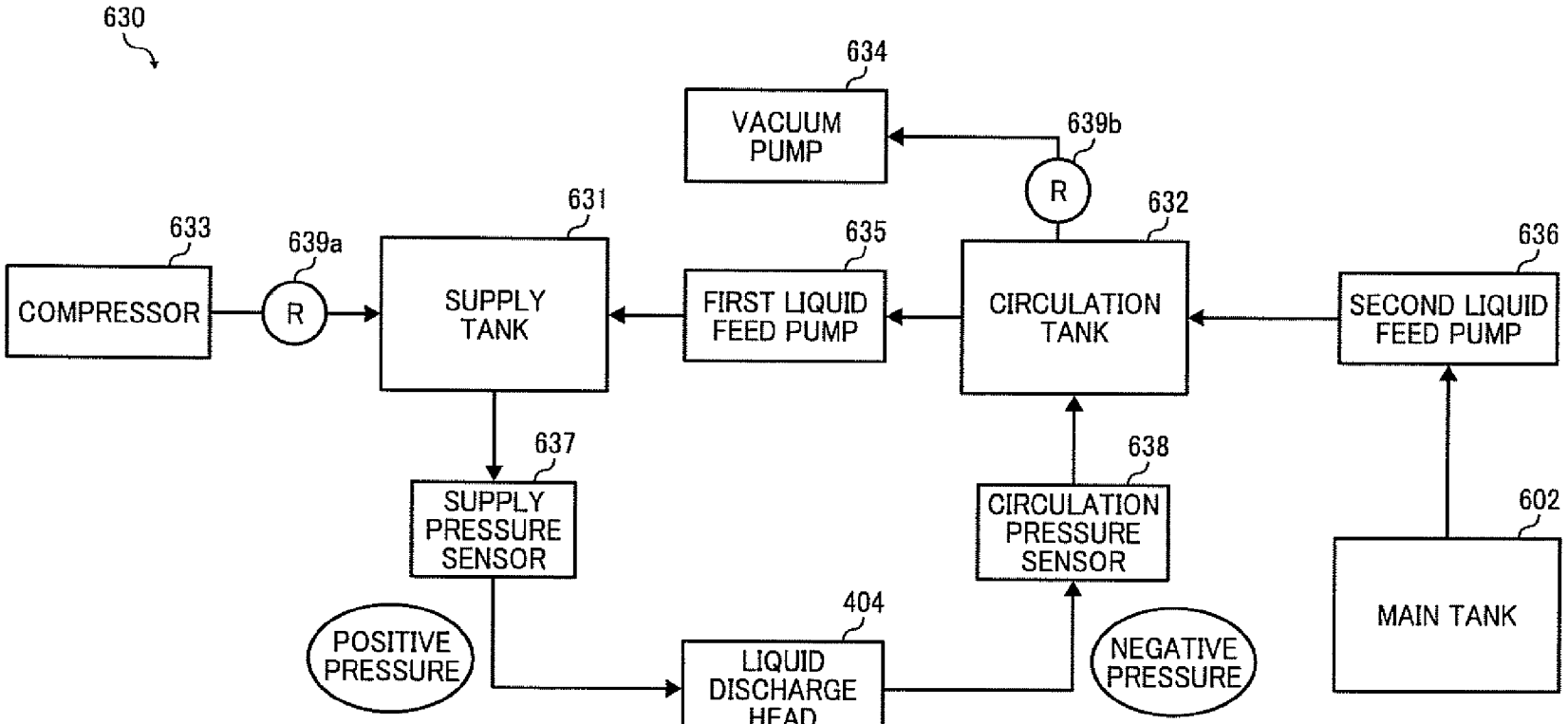
FIG. 15 is a block diagram of a liquid circulation system of the liquid discharge apparatus of FIG. 13 according to an embodiment of the present disclosure.

Next, an example of a liquid circulation system according to an embodiment of the present disclosure is described with reference to FIG. 15. FIG. 15 is a block diagram of the liquid circulation system according to an embodiment of the present disclosure.

A liquid circulation system 630 illustrated in FIG. 20 includes, e.g., a main tank 602, the liquid discharge head 404, a supply tank 631, a circulation tank 632, a compressor 633, a vacuum pump 634, a first liquid feed pump 635, a second liquid feed pump 636, a supply pressure sensor 637, a circulation pressure sensor 638, a regulator (R) 639*a*, and a regulator (R) 639*b*.

The supply pressure sensor 637 is disposed between the supply tank 631 and the liquid discharge head 404 and connected to a supply channel side connected to the supply ports 23 (see FIG. 1) of the liquid discharge head 404. The circulation pressure sensor 638 is disposed between the liquid discharge head 404 and the circulation tank 632 and is connected to a circulation channel side connected to the circulation ports 46 (see FIG. 1) of the liquid discharge head 404.

One end of the circulation tank 632 is connected to the supply tank 631 via the first liquid feed pump 635 and the other end of the circulation tank 632 is connected to the main tank 602 via the second liquid feed pump 636.

Thus, liquid is flown from the supply tank 631 into the liquid discharge head 404 through the supply ports 23 and output from the circulation ports 46 to the circulation tank 632. Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637. The circulation tank 632 is connected to the vacuum pump 634 and controlled so that a predetermined negative pressure is detected with the circulation pressure sensor 638.

Such a configuration allows the menisci of ink to be maintained at a constant negative pressure while circulating ink through the inside of the liquid discharge head 404.

When droplets are discharged from the nozzles 4 of the liquid discharge head 404, the amount of liquid in each of the supply tank 631 and the circulation tank 632 decreases. Hence, the second liquid feed pump 636 replenishes liquid from the main tank 602 to the circulation tank 632. The replenishment of liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, and ceramics, to which liquid can adhere even temporarily.

The liquid may be, e.g., ink, treatment liquid, DNA sample, resist, pattern material, binder, and mold liquid.

The liquid discharge apparatus may be, unless in particular limited, any of a serial-type apparatus to move the liquid discharge head and a line-type apparatus not to move the liquid discharge head.

The liquid discharge apparatus may be, for example, a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may be, for example, a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 10. The liquid discharge head and the head tank may be connected each other via, e.g., a tube to form the liquid discharge device as the integrated unit. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by the guide that forms part of the main scan moving unit, so that the liquid discharge head and the main scan moving unit are integrated as a single unit. Like the liquid discharge device 440A illustrated in FIG. 11, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 12, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles to discharge liquid;

a plurality of individual liquid chambers communicated with the plurality of nozzles;

a common liquid chamber to supply liquid to the plurality of individual liquid chambers;

a common circulation liquid chamber communicated with the plurality of individual liquid chambers; and a filter portion disposed in the common liquid chamber to filter liquid, wherein the common liquid chamber includes:

a first portion disposed side by side with the common circulation liquid chamber in a direction perpendicular to a nozzle array direction in which the plurality of nozzles is arrayed in row; and a second portion not disposed side by side with the common circulation liquid chamber in the direction perpendicular to the nozzle array direction, wherein, in a plan view, the second portion partially overlaps the common circulation liquid chamber in the direction perpendicular to the nozzle array direction, and wherein a width of the second portion in the direction perpendicular to the nozzle array direction is greater than a width of the first portion in the direction perpendicular to the nozzle array direction, and wherein, in the plan view, the filter portion is disposed in the second portion.

2. The liquid discharge head according to claim 1, wherein, where a side of the common liquid chamber communicated with the plurality of individual liquid chambers is a downstream side in a direction of flow of liquid in the liquid discharge head, the first portion is a downstream portion of the common liquid chamber and the second portion is an upstream portion of the common liquid chamber.

3. The liquid discharge head according to claim 1, wherein, in the plan view, the first portion of the common liquid chamber and the common circulation liquid chamber are disposed in the second portion in the direction perpendicular to the nozzle array direction.

4. The liquid discharge head according to claim 1, further comprising a common-liquid-chamber substrate including the common liquid chamber and the common circulation liquid chamber, wherein at least a portion of the common-liquid-chamber substrate is a plurality of plates laminated one on another.

5. The liquid discharge head according to claim 1, further comprising a filter member including the filter portion;

the filter member including:

a thin portion including the filter portion; and a thick portion around the thin portion, wherein a portion of the thick portion thicker than the thin portion is disposed downstream from the thin portion in a direction of flow of liquid in the liquid discharge head.

6. The liquid discharge head according to claim 1, wherein a width of the common liquid chamber in the direction perpendicular to the nozzle array direction is narrower toward a downstream side in a direction of flow of liquid in the liquid discharge head.

7. A liquid discharge device comprising the liquid discharge head according to claim 1 to discharge liquid.

8. The liquid discharge device according to claim 7, wherein the liquid discharge head is integrated as a single unit with at least one of:

a head tank to store liquid to be supplied to the liquid discharge head;

a carriage mounting the liquid discharge head;

a supply unit to supply liquid to the liquid discharge head;

a maintenance unit to maintain and recover the liquid discharge head; and a main scan moving unit to move the liquid discharge head in a main scanning direction.

9. A liquid discharge apparatus comprising the liquid discharge device according to claim 7 to discharge liquid.

10. A liquid discharge apparatus comprising the liquid discharge head according to claim 1 to discharge liquid.

* * * * *